US007237575B2

(12) United States Patent
Dini

(10) Patent No.: US 7,237,575 B2
(45) Date of Patent: Jul. 3, 2007

(54) TETRAXIAL FABRIC AND MACHINE FOR ITS MANUFACTURE

(75) Inventor: Mamiliano Dini, Segrate (IT)

(73) Assignee: Tetraxial S.R.L. (IT)

( * ) Notice: Subject to any disclaimer, the term of this patent is extended or adjusted under 35 U.S.C. 154(b) by 296 days.

(21) Appl. No.: 10/485,777

(22) PCT Filed: Jul. 1, 2002

(86) PCT No.: PCT/IT02/00433

§ 371 (c)(1),
(2), (4) Date: May 28, 2004

(87) PCT Pub. No.: WO03/012184

PCT Pub. Date: Feb. 13, 2003

(65) Prior Publication Data

US 2005/0011576 A1 Jan. 20, 2005

(30) Foreign Application Priority Data

Jul. 31, 2001 (IT) ..... MI2001A1665

(51) Int. Cl.
*D03D 41/00* (2006.01)
*D03D 13/00* (2006.01)
*D03D 25/00* (2006.01)

(52) U.S. Cl. ..... 139/11; 139/180; 139/DIG. 1

(58) Field of Classification Search ..... 139/180, 139/11, DIG. 1; 442/203, 205, 206, 207
See application file for complete search history.

(56) References Cited

U.S. PATENT DOCUMENTS

| | | | | | |
|---|---|---|---|---|---|
| 4,438,173 | A | * | 3/1984 | Trost | 428/221 |
| 5,351,722 | A | * | 10/1994 | Mamiliano | 139/180 |
| 5,375,627 | A | * | 12/1994 | Iida et al. | 139/11 |
| 5,431,193 | A | * | 7/1995 | Mood et al. | 139/11 |
| 5,472,020 | A | * | 12/1995 | Iida et al. | 139/384 R |
| 5,540,260 | A | * | 7/1996 | Mood | 139/11 |
| 5,947,160 | A | * | 9/1999 | Addis et al. | 139/11 |
| 6,071,835 | A | * | 6/2000 | Tang et al. | 442/216 |
| 6,429,157 | B1 | * | 8/2002 | Kishi et al. | 442/227 |
| 2005/0011576 | A1 | * | 1/2005 | Dini | 139/20 |

FOREIGN PATENT DOCUMENTS

| | | | |
|---|---|---|---|
| EP | 0 643 161 | A | 3/1995 |
| EP | 0 263 392 | A | 4/1998 |
| FR | 2 702 222 | A | 9/1994 |

OTHER PUBLICATIONS

International Search Report.

* cited by examiner

*Primary Examiner*—Robert H Muromoto
(74) *Attorney, Agent, or Firm*—Ostrolenk, Faber, Gerb & Soffen, LLP

(57) ABSTRACT

A tetraxial fabric is obtained using warp yarns, weft yarns, first bias yarns and second bias yarns. The warp yarns alternate to the weft yarns and the first bias yarns are overlaid by the second bias yarns, in addition the first bias yarns cross the second bias yarns at the crossover points of the warp yarns with the weft yarns. The invention includes also a machine to manufacture the said tetraxial fabric.

15 Claims, 7 Drawing Sheets

TETRAXIAL FABRIC AND MACHINE FOR ITS MANUFACTURE

This invention concerns a tetraxial fabric and a machine for its manufacture.

As is known, in the textile field, besides the traditional warp and weft fabrics, tetraxial fabrics are known, i.e. fabrics consisting of warp and weft yarns as well as first and second bias yarns which crisscross each other along two different diagonal directions. In such fabrics the bias yarns cross also the warp and weft yarns.

The first tetraxial fabrics developed in the art consisted of bias yarns crossing in the fabric areas included between the warp and the weft yarns.

This fabric geometry did not provide either a close bond between yarns or an optimum fabric fill coefficient.

Tetraxial fabrics are known also from the U.S. Pat. No. 5,351,722, where a tetraxial fabric is described which contains warp yarns, weft yarns as well as first and second bias yarns crisscrossing each other and both the warp and weft yarns.

In such tetraxial fabrics a first course of warp yarns is overlaid by the weft yarns and overlies the first and second bias yarns, while a second course of warp yarns, which alternates to the mentioned first yarn course, overlies the weft yarns and is overlaid by the first and second bias yarns.

Fabrics of the latter type, though overcoming the problems that arise with fabrics of the former type, are suitable for further improvements.

As a matter of fact the structure of such tetraxial fabrics is in any case asymmetrical due to the fact that the warp yarns are alternatively above or under the weft yarns, so that only the first and second bias yarns contribute substantially to the strength of the fabric.

The object of this invention is therefore to resolve the above-mentioned problems by making tetraxial fabrics characterized by a total symmetry.

A further object of this invention is to make a tetraxial fabric in which the angles of the first and second bias yarns can be controlled as desired.

A further object of this invention is to make a tetraxial fabric that can reach an optimum fill coefficient of up to 100%.

The said objects are achieved, according to this invention, by a tetraxial fabric according to claim 1, to which reference is made for the sake of brevity.

The invention concerns also a machine to manufacture a tetraxial fabric, as described in claim 5, to which reference is made for the sake of brevity.

The tetraxial fabric exhibits a number of advantages, including the possibility of being made either with a partial fabric fill coefficient or with a 100% fill coefficient.

It exhibits total symmetry because it is made with alternating warp and weft yearns, as in ordinary fabrics. Among other things, this symmetry provides a fabric where the front and back sides are alike.

Therefore the fabric of the invention has a high resistance to deformation, which makes it ideal for a number of industrial applications such as inflatable boat plies, filter fabric, tarpaulins, etc.

The machine to manufacture the tetraxial fabric allows, among other things, the weaving of a large number of yarns, where the limit is set by the thickness of each needle.

In addition, it has a single beater which intervenes after each weft drawing-in, thus limiting the room needed, and allowing fabrics containing more yarns per centimeter to be obtained.

Other important advantages of the machine of the invention are due to the fact that the presence of a single moving warp, in cooperation with the stationary warp, makes the machine simpler and with fewer elements to be synchronized; the single beater simplifies further said synchronisms, in addition the bias yarn pulling system has a simple step-by-step motion which is easy to achieve and accurate in operation.

The invention is described in detail below as a non-limitative example, with reference to the attached drawings, where:

Figure 1:
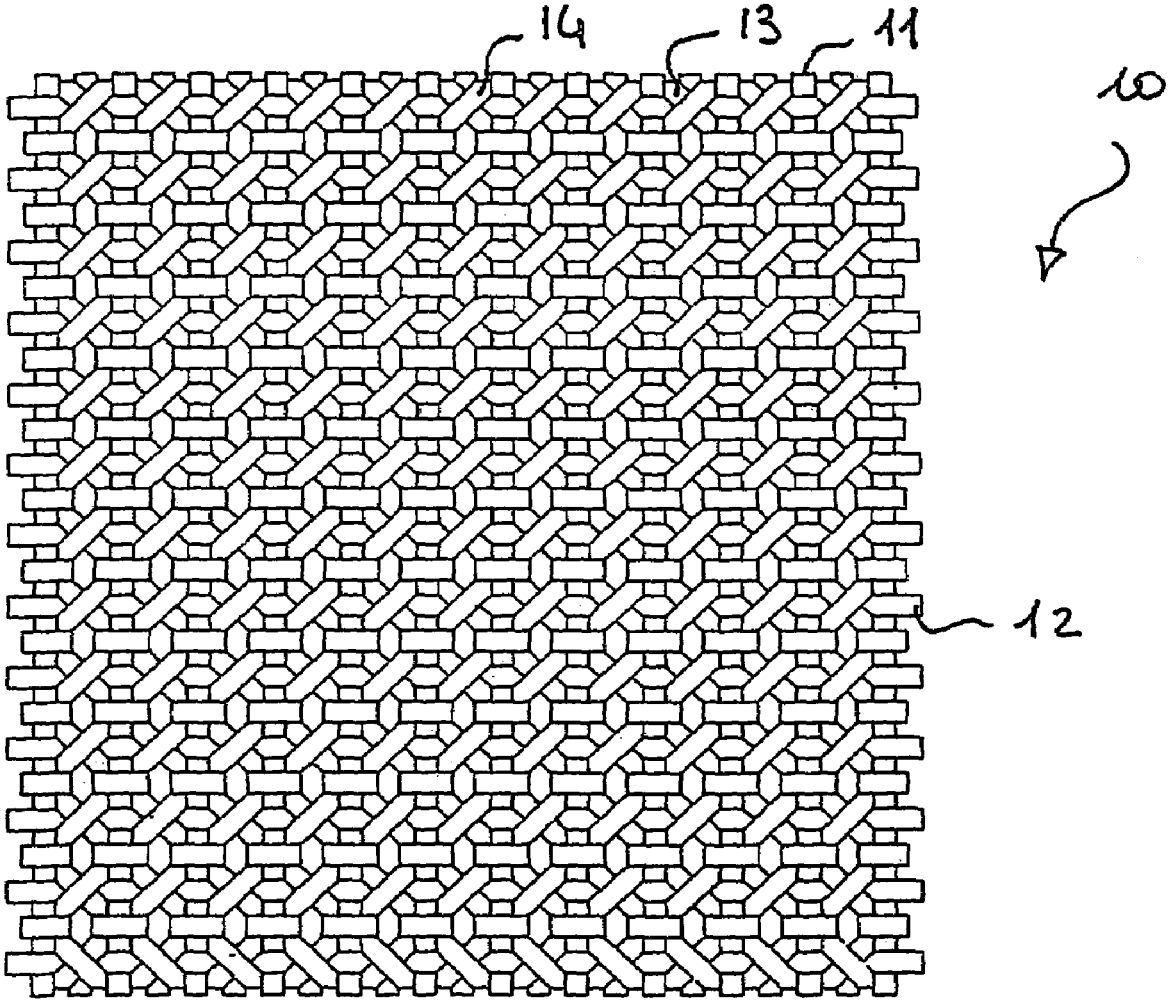
FIG. 1 is a plan view of the tetraxial fabric according to the first embodiment of this invention.

The tetraxial fabric according to this invention is indicated globally with the reference numeral 10 in the attached figures.

FIG. 1 shows a tetraxial fabric 10 obtained with warp yarns 11, weft yarns 12, first bias yarns 13 and second bias yarns 14, all in the same thickness.

Therefore the tetraxial fabric 10 exhibits a set of warp yarns 11 alternating to weft yarns 12, as in traditional fabrics.

The first bias yarns 13 cross the second bias yarns 14 at the crossover points of the warp yarns 11 and weft yarns 12, and in addition the first bias yarns 13 are overlaid by the second bias yarns 14.

Figure 2:
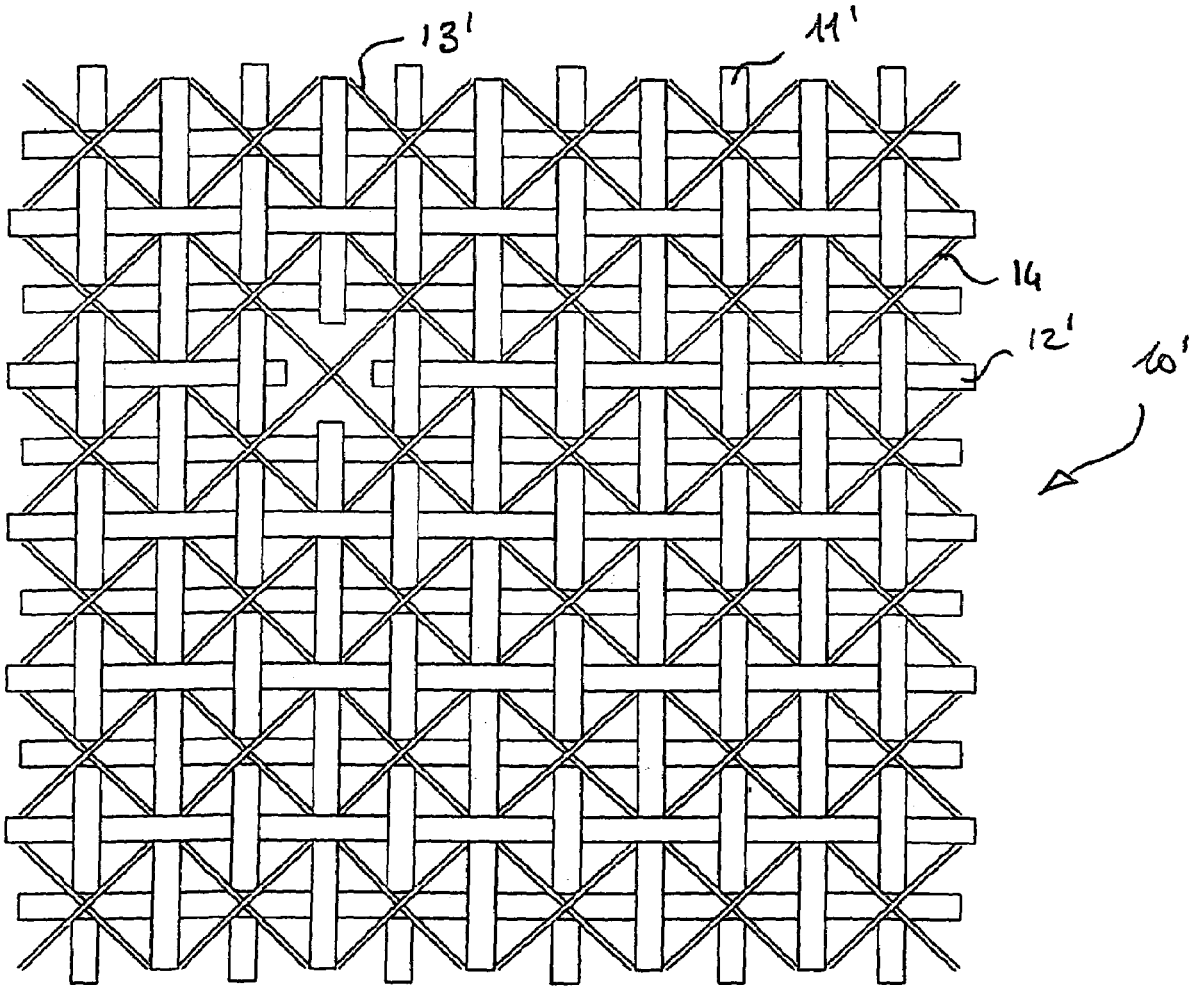
FIG. 2 is a plan view of the tetraxial fabric according to another embodiment of this invention.

FIG. 2 shows the tetraxial fabric 10', which has been obtained using warp yarns 11', weft yarns 12', thicker than the first bias yarns 13' and the second bias yarns 14', so as to provide a tetraxial fabric with partial fill coefficient.

Also in this case the first bias yarns 13' cross the second bias yarns 14' at the crossover points of the warp yarns 11' and the weft yarns 12'.

Figure 3:
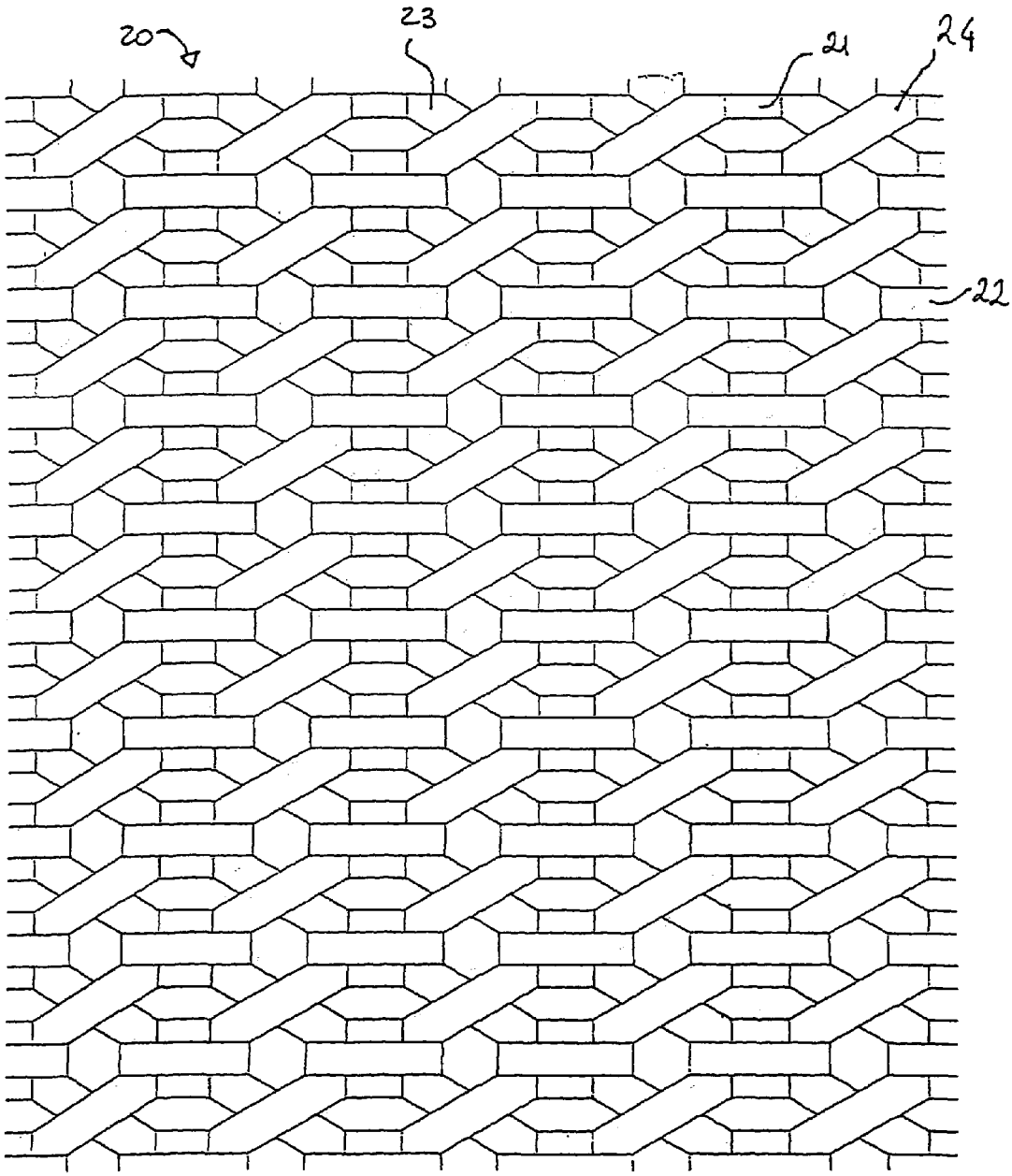
FIGS. 3 through 5 are plan views of the tetraxial fabric according to further embodiments of this invention.

FIG. 3 shows, by way of example, the tetraxial fabric 20, obtained with warp yarns 21, weft yarns 22; the first bias yarns 23 and second bias yarns 24 being inclined in such a way as to form a 40 deg angle with the weft yarns 22.

The interlacing of the first and second bias yarns can be made with the desired angle.

Figure 4:
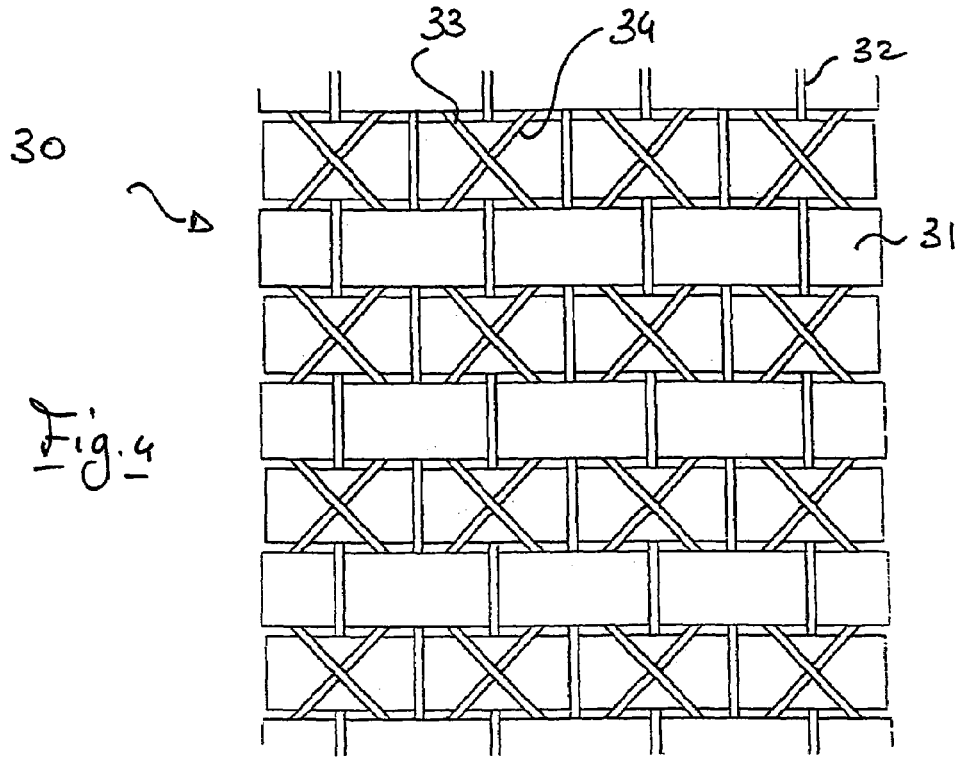
Figure 5:
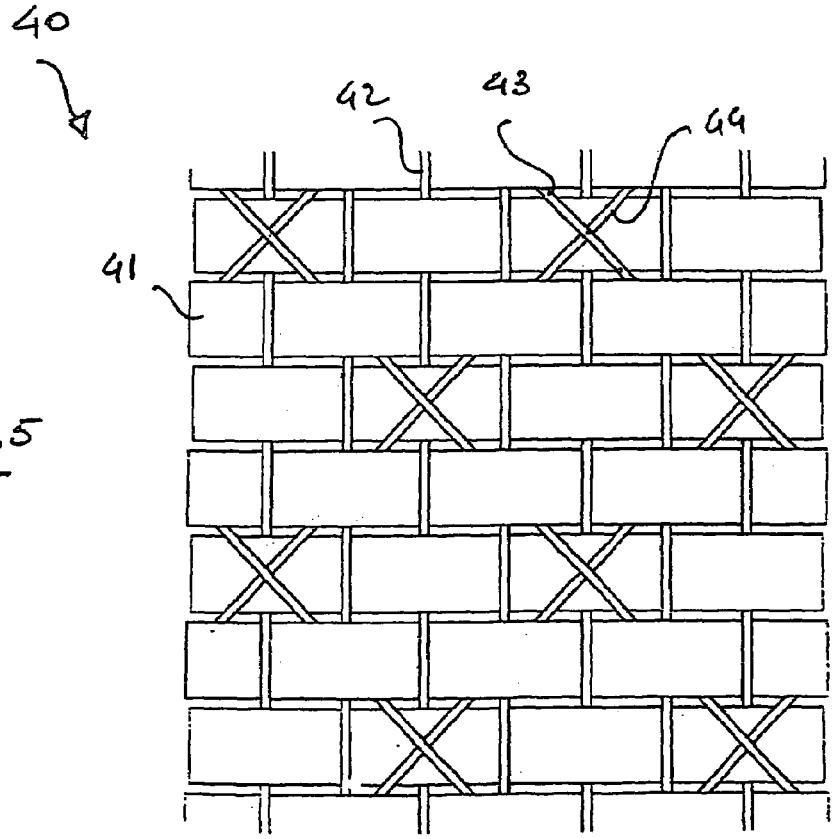

FIG. 4 shows the tetraxial fabric 30, which has been obtained using warp yarns 31, weft yarns 32, first bias yarns 33 and second bias yarns 34; the warp yarns 31 are bigger in size than the weft yarns 32; while FIG. 5 shows the tetraxial fabric 40, in which the warp yarns 41 are bigger in size than the weft yarns 42, and the first and second bias yarns 43 and 44 are arranged at bigger intervals.

This invention covers also a machine 50 for the manufacture of the tetraxial fabric according to this invention.

Figures 6, 7:
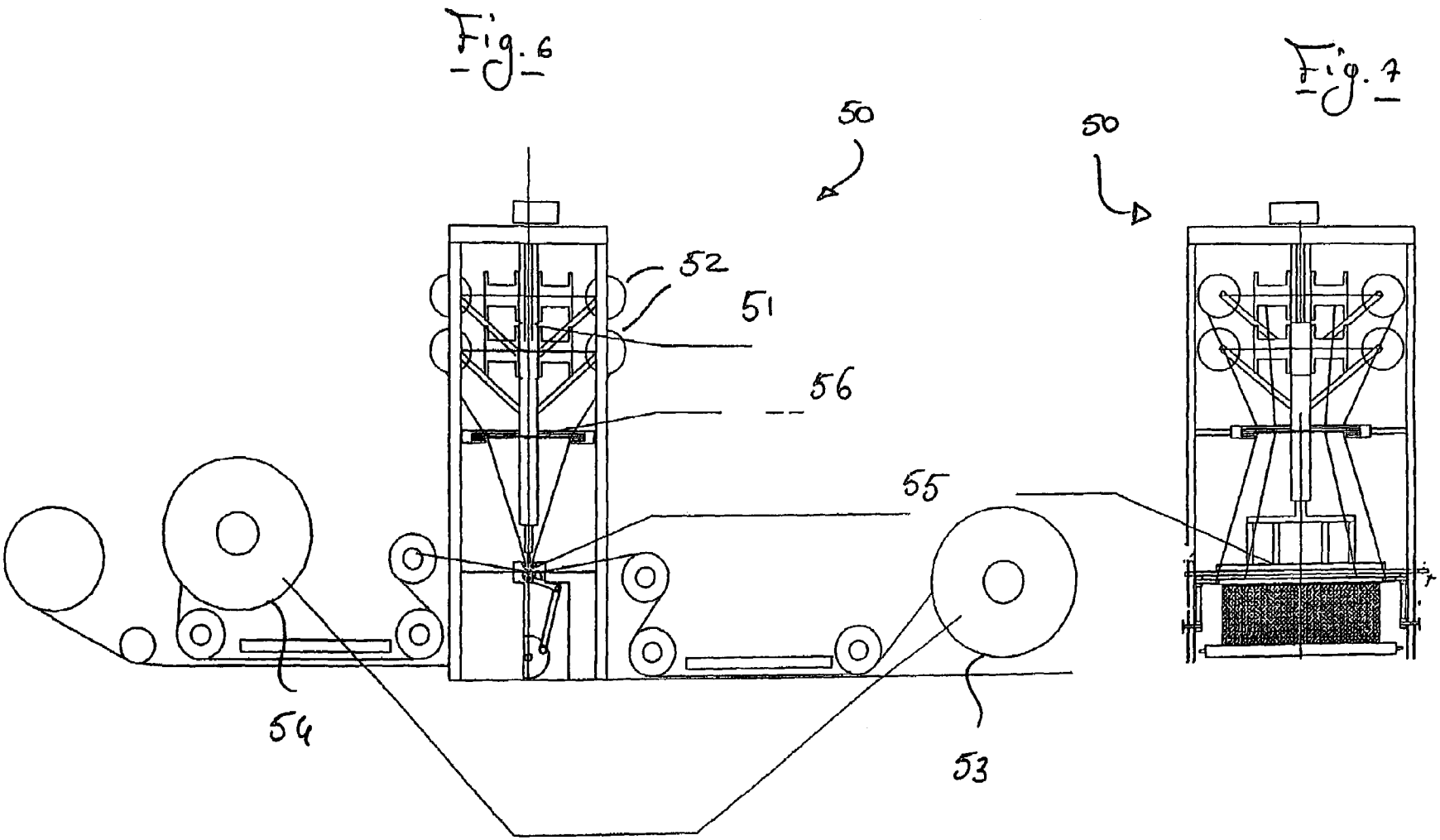
FIG. 6 is a side view of the machine to make the tetraxial fabric according to this invention.
FIG. 7 is a front view of the machine for the manufacture of the tetraxial fabric of the invention.

The machine 50, globally shown in FIGS. 6 and 7, comprises a bearing structure 51, or castle, on which the beams 52 are mounted, which are relevant to the first and second bias yarns, as well as a guide ring 56, while the warp beams 53 and 54 are located at the sides and outside of the bearing structure 51.

The machine 50 also comprises means for guiding the warp yarns, means for guiding the weft yarns and means for guiding the first and second bias yarns toward a fabric formation area 55.

In particular, the machine comprises a first and a second guide member for guiding the warp yarns which are mounted to face each other and where one of these members is movable and the other one is stationary.

The first and the second warp yarn guide members comprise opposite holder bars, each carrying a set of needles which are substantially parallel to one another. This allows weaving even with a large number of needles, the limit being set by the thickness of each needle.

Figure 8:
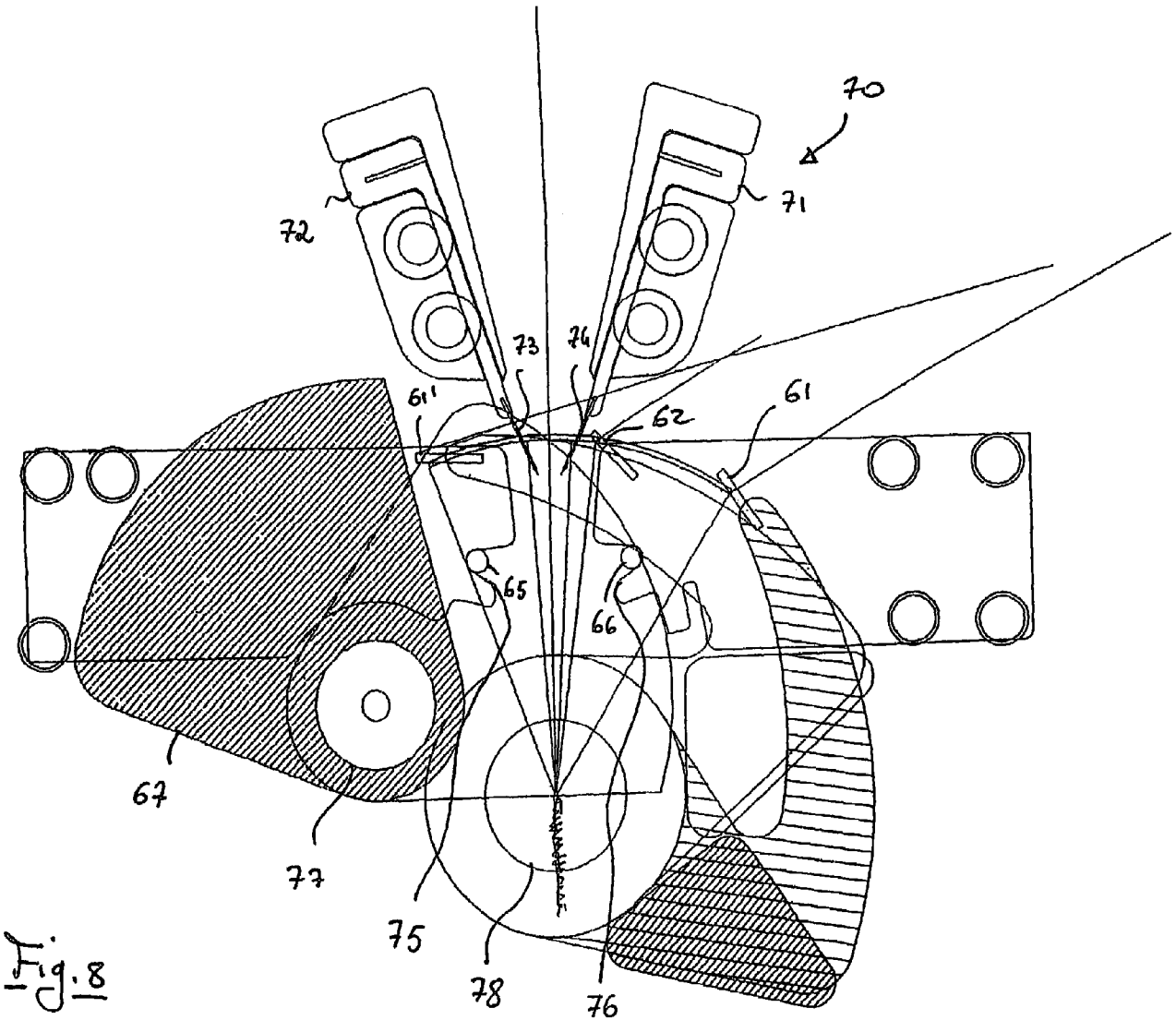
FIG. 8 is a vertical cross-sectional view which shows some components of the machine for the manufacture of the tetraxial fabric of the invention.
Figures 9A, 9B, 9C, 9D, 9E:
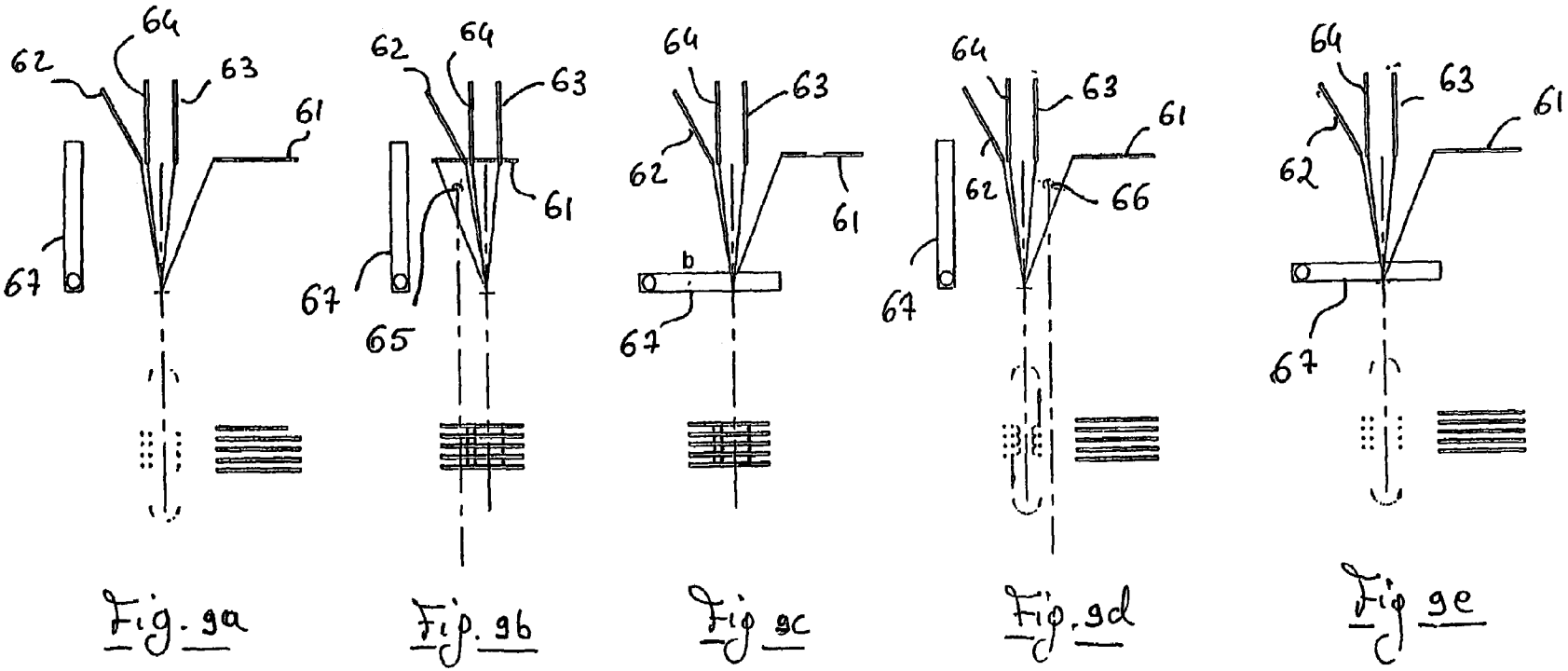
FIGS. 9*a* through 9*e* are schematic diagrams illustrating the main operating steps of the said machine.

In FIG. 8, 61 indicates the moving warp in its idling position and 61' indicates the same moving warp in its working position. The moving warp 61 is moved with angular motion by a motor which rotates the shaft 78.

The means guiding the weft yarns 65 and 66, instead, comprise two pickers of known construction and arranged side by other. The pickers move with reciprocating linear motion between a retracted and an extended position, with a motion direction perpendicular to the motion direction of the moving member for the warp yarns. Also the guides 75 and 76 for the weft yarns 65 and 66 can be seen in figure B.

Other known weft yarn guiding means can be used as an alternative.

The first and second bias yarns guiding means comprise an entrainment system 70 which carries a set of plates 71, 72, each provided with a needle 73, 74 through which either of the mentioned bias yarns is passed. The entrainment system 70 is operated by a stepper motor (not shown).

A carousel is also provided hanging from the bearing structure 51 said carousel housing a set of bobbins 52 to unwind the mentioned bias yarns; a single beater 67 is finally provided, which rotates over a certain angle thanks to the shaft 77.

With reference to FIGS. 9*a* through 9*e*, the working cycle of the machine 50 according to this invention is described below.

At the start of the cycle the needles carrying the moving warp yarns face one another in a position which is offset with respect to the needles that carry the stationary warp yarns so that the moving warp will not interfere either with the stationary warp or with the first and second bias yarns.

In the first operating step of the cycle the moving warp 61 moves forward through the first and second bias yarns 63, 64 and through the stationary warp yarns, followed by the drawing-in of the weft 65.

Now the moving warp returns to the start position and a first beating operation is performed by the single beater 67.

At this point the entrainment system 70 which moves the first and second bias yarns 63, 64 moves one step, so the first bias yarns 63 move sideways in one direction while the second bias yarns 64 move sideways in the opposite direction, so the first and second bias yarns 63, 64 cross each other. The movement of the bias yarns causes also the movement of the last plates at the end of the needle bed, which turn each 180 degrees, thereby reaching a new working position.

Subsequently the weft 66 is passed and a second beating operation is performed by the single beater 67.

Note that the insertion means for the weft yarns 65, 66 can be located either at the opposite side ends of the machine or both on the same side. A single feeding system can be provided to feed the weft yarns 65, 66, which feeds the weft 65 and then the weft 66.

The above-mentioned weaving cycle is then repeated as many times as required to obtain the tetraxial fabric of the invention.

Lastly, it is stressed that one of the weft yarns (66) should be inside the triangle formed by the moving warp 61, in its idling position, and by the assembly comprising the first and second bias yarns 63, 64 and by the stationary warp 62, while the other weft yarn (65) should be inside the triangle formed by the moving warp 61, in extended or working position, and the assembly consisting of the first and second bias yarns 63, 64 and by the stationary warp 62. This geometric relationship occurs both in the case of FIG. 8, where the stationary weft 62 is beyond the centerline of the machine, and in the case of FIGS. 9*a* through 9*e*, where the stationary warp 62 is this side of the machine centreline, both cases having been presented as examples of the possible alternative embodiments of the machine 50, all of them being included in the inventive concepts presented in the specification and covered by the attached claims.

This invention can be the object of a number of modifications or variations, all falling within the invention concept contained in the attached claims, while the technical details can be changed as required.

The invention claimed is:

1. A tetraxial fabric comprising warp yarns, weft yarns, first bias yarns and second bias yarns, wherein each of the warp yarns is woven with each of the weft yarns and the first bias yarns are overlaid by the second bias yarns such that the first bias yarns are not woven with the second bias yarns, where the first bias yarns crisscross with the second bias yarns at a crossover point of the warp yarns with the weft yarns, and wherein each of the first and second bias yarns is woven with each warp yarn and each weft yarn.

2. A tetraxial fabric according to claim 1, wherein the first and second bias yarns crisscross along directions inclined at a desired angle.

3. A tetraxial fabric according to claim 1, wherein the weft yarns, the warp yarns and the first and second bias yarns are different in size so as to make a tetraxial fabric with a partial fill coefficient.

4. A tetraxial fabric according to claim 1, wherein the first and second bias yarns are woven at a distance from crossover points of the weft yarns with the warp yarns.

5. A machine for the manufacture of a tetraxial fabric comprising warp yarns, weft yarns, first bias yarns and second bias yarns, wherein the warp yarns are interlaced with the weft yarns and the first bias yarns are overlaid by the second bias yarns, where the first bias yarns crisscross with the second bias yarns at a crossover point of the warp yarns with the weft yarns, the machine comprising:

a bearing structure comprising first beams associated with the first and second bias yarns and first and second bias yarn supplies from which the first and second bias yarns are respectively supplied;

warp beams positioned laterally away from the bearing structure and operable to supply the warp yarns;

warp yarn guiding means operable to guide the warp yarns from the warp beams to a fabric formation area, a weft yarn feeder operable to supply the weft yarns;

weft yarn insertion means operable to guide the weft yarns from the weft yarn feeder to the fabric formation area; and means for guiding the first and second bias yarns from the first and second bias yarn supplies toward the fabric formation area, wherein the warp yarn guiding means includes first and second warp yarn guiding members and where the first and second warp yarn guiding members face each other and at least one of the first and second warp yarn guiding members is movable while the other is stationary for interweaving the warp yarns with the weft yarns at the fabric formation area.

6. A machine according to claim 5, wherein the first and second warp yarn guiding members include opposite and offset holder bars, each bar carrying a set of needles which are substantially parallel to one another.

7. A machine according to claim 5, wherein the weft yarn insertion means are placed at opposite side ends of the machine.

8. A machine according to claim 6, wherein the means for guiding the first and second bias yarns includes an entrainment system which carries a set of plates, wherein each plate is provided with a needle through which any of the first and second bias yarns is passed.

9. A machine according to claim 5, wherein a single beater is provided to perform a beating operation in the fabric formation area.

10. A tetraxial fabric according to claim 2, wherein the weft yarns, the warp yarns and the first and second bias yarns are different in size so as to make a tetraxial fabric with a partial fill coefficient.

11. A machine according to claim 6, wherein the weft yarn insertion means are placed at opposite side ends of the machine.

12. A machine according to claim 5, wherein the weft yarn insertion means are positioned on one side of the machine.

13. A machine according to claim 5, wherein the weft yarn insertion means include a weft feeding system that feeds a first weft yarn first and a second weft yarn later.

14. A machine according to claim 6, wherein the weft yarn insertion means are positioned on one side of the machine.

15. A machine according to claim 6, wherein the weft yarn insertion means include a weft feeding system that feeds a first weft yarn first and a second weft yarn later.

* * * * *